US007715585B2

(12) United States Patent
Nagata et al.

(10) Patent No.: US 7,715,585 B2
(45) Date of Patent: May 11, 2010

(54) SPEAKER

(75) Inventors: Yuka Nagata, Osaka (JP); Masahide Suzuki, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 911 days.

(21) Appl. No.: 11/076,923

(22) Filed: Mar. 11, 2005

(65) Prior Publication Data

US 2005/0201587 A1 Sep. 15, 2005

(30) Foreign Application Priority Data

Mar. 11, 2004 (JP) ..... 2004-068968

(51) Int. Cl.
*H04R 25/00* (2006.01)

(52) U.S. Cl. ..... 381/412; 431/394; 431/395; 431/189

(58) Field of Classification Search ..... 381/189, 381/191, 394, 395, 396, 409, 419, 412, 431
See application file for complete search history.

(56) References Cited

U.S. PATENT DOCUMENTS 3,079,472 A * 2/1963 Sariti ..... 381/420
5,625,700 A * 4/1997 Sone ..... 381/396
5,956,622 A * 9/1999 Lee ..... 340/7.6
6,400,825 B1 * 6/2002 Miyamoto et al. ..... 381/409

FOREIGN PATENT DOCUMENTS

JP 2003-37890 2/2003
JP 2003-37895 2/2003

* cited by examiner

*Primary Examiner*—Suhan Ni
*Assistant Examiner*—Jasmine Pritchard
(74) *Attorney, Agent, or Firm*—Bacon & Thomas, PLLC

(57) ABSTRACT

In the speaker of the invention, a circular outer magnet type magnetic circuit 8, and a diaphragm 13 to which a circular voice coil 14 driven by the circuit is fixed are held on a rectangular frame 1. The circular outer magnet type magnetic circuit 8 is configured by: a yoke 9 in which a rectangular flange 9*b* is disposed in one end of a circular center pole 9*a*; a plate-like magnet 10 which has a circular center hole 10*a*, which is placed with forming a circular annular gap around the yoke center pole 9*a*, and which has a rectangular outer shape that is substantially identical with the outer shape of the yoke flange 9*b*; and a circular annular pole piece 11 which is substantially equal in inner diameter to the magnet center hole 10*a*, in which the outer diameter is substantially equal to short side dimensions of the yoke flange 9*b* and the magnet 10, and which cooperates with the yoke flange 9*b* to clampingly hold the magnet 10. A circular magnetic gap 12 is formed between the yoke center pole 9*a* and the pole piece 11. The magnet 10 is split into two portions in a center area in the longitudinal direction.

13 Claims, 6 Drawing Sheets

SPEAKER

BACKGROUND OF THE INVENTION

1. Field of the Invention

The present invention relates to a speaker which is used mainly as a receiver of a mobile communication equipment such as a portable telephone.

2. Description of the Prior Art

Conventionally, there is a narrow rectangular speaker in which a rectangular inner magnet type magnetic circuit, and a diaphragm to which a rectangular voice coil driven by the magnetic circuit is fixed are held on a rectangular frame. In such a speaker, the rectangular inner magnet type magnetic circuit is configured by: a rectangular yoke which is held by the frame; a magnet which is joined to the bottom face of the yoke, and which has a rectangular plate-like shape; and an upper plate which is joined to the upper face of the magnet, and which has a rectangular plate-like shape, and a rectangular magnetic gap into which the rectangular voice coil is to be fitted is formed between the inner wall face of the yoke and the outer side face of the upper plate. When an audio signal current is supplied to the voice coil, the diaphragm to which the voice coil is fixed is vibrated by an electromagnetic action with a magnetic field in the magnetic gap, to generate a sound or a voice. Examples of such a speaker are disclosed in Japanese Patent Application Laying-Open Nos. 2003-37895 and 2003-37890.

SUMMARY OF THE INVENTION

As a magnetic circuit for a speaker, in addition to the inner magnet type magnetic circuit in which a magnet is placed inside a magnetic gap, known is an outer magnet type magnetic circuit in which a magnet is placed outside a magnetic gap. The outer magnet type magnetic circuit has advantages that the height can be made smaller than that in the case of an inner magnet type one, and that a large coil driving force (sound pressure) can be ensured by a small magnet, and hence is effective in further miniaturization and thinning of a speaker. In the inner magnet type, a magnet is formed into a plate-like shape, so that higher strength can be easily ensured. In the outer magnet type, by contrast, a magnet is formed into an annular (frame-like) shape in which higher strength is hardly ensured. Therefore, it is difficult to employ an outer magnet type magnetic circuit in an actual device from the viewpoint of production of a magnet. It is an object of the invention to provide a structure in which an outer magnet type magnetic circuit can be employed while solving the problem, and a speaker can be further miniaturized and thinned.

Therefore, the invention set forth in claim 1 provides a speaker wherein a circular outer magnet type magnetic circuit, and a diaphragm to which a circular voice coil driven by the magnetic circuit is fixed are held on a rectangular frame. As set forth in claim 2, preferably, the circular outer magnet type magnetic circuit is configured by: a yoke in which a rectangular flange is disposed in one end of a circular center pole; a plate-like magnet which has a circular center hole, which is placed with forming a circular annular gap around the yoke center pole, and which has a rectangular outer shape that is substantially identical with an outer shape of the yoke flange; and a circular annular pole piece which is substantially equal in inner diameter to the magnet center hole, in which an outer diameter is substantially equal to short side dimensions of the yoke flange and the magnet, and which cooperates with the yoke flange to clampingly hold the magnet, and a circular magnetic gap into which the circular voice coil is fitted is formed between an outer peripheral face of the yoke center pole of the magnetic circuit and an inner peripheral face of the pole piece.

According to the invention set forth in claim 1, a magnet which is usually used in the circular outer magnet type magnetic circuit has a circular annular shape, and hence higher strength can be ensured as compared with a rectangular annular (frame-like) magnet which is usually used in a rectangular outer magnet type magnetic circuit. When, as set forth in claim 2, the magnet used in the outer magnet type magnetic circuit is a plate-like magnet which has a circular center hole, which is placed with forming a circular annular gap around the yoke center pole, and which has a rectangular outer shape that is substantially identical with the outer shape of the yoke flange, moreover, it is possible to ensure more higher strength than a circular annular magnet which is usually used in a circular outer magnet type magnetic circuit. Therefore, losses due to cracks, edge defects, and the like in production of magnets are reduced, and the productivity can be enhanced. Consequently, an outer magnet type magnetic circuit can be employed without problems as a magnetic circuit for a speaker held on a rectangular frame, and further miniaturization and thinning of a speaker can be realized.

Even in a plate-like magnet which has a circular center hole, which is placed with forming a circular annular gap around a yoke center pole, and which has a rectangular outer shape that is substantially identical with an outer shape of the yoke flange, when the short side dimension of the magnet is shorter than the outer diameter of a circular annular magnet which is usually used in a circular outer magnet type magnetic circuit, the strength is insufficient in two places where the center hole of the magnet is closest to the longitudinal outer side edges, thereby causing a possibility that cracks occur in the two places, and hence miniaturization of a speaker in the short side direction is particularly difficult. As set forth in claim 3, consequently, it is preferable to configure such a magnet to, in place of an integral structure, have a split structure in which the magnet is originally split into two portions in a center area in a longitudinal direction, or to be formed as a magnet configured by two split magnets. According to this magnet configuration, even when the short side dimension of the magnet is shorter than the outer diameter of a circular annular magnet which is usually used in a circular outer magnet type magnetic circuit, it is possible to ensure strength which is not problematic in production of the magnet. Therefore, further miniaturization of a speaker in the short side direction can be realized. When a speaker is requested to be further miniaturized, the number of split magnets may be adequately increased, so that insufficiency of strength can be solved and the request can be satisfied.

As set forth in claim 4, the circular outer magnet type magnetic circuit can be configured so that a rectangular recess is formed in one surface of the frame opposite to a face to which the diaphragm is attached, a circular through hole penetrating to the face of the frame to which the diaphragm is attached is opened in a bottom face of the recess, and the recess allows the magnetic circuit to be held on the frame. Specifically, as set forth in claim 5, the magnet is fitted into the recess of the frame, the yoke flange is fitted into the recess so as to overlap an outer side of the magnet while inserting the yoke center pole into the magnet center hole, whereby the yoke center pole is caused to hang at a center of the recess, a tip end portion of the yoke center pole is insertedly placed at a center of the through hole, and the magnet is placed in a state where a circular annular gap is formed around the yoke center pole, and, in this state, the pole piece is fitted to an inner periphery of the through hole from a side of the face of the frame to which the diaphragm is attached, whereby the pole piece is placed in a state where a circular annular gap is formed around the tip end portion of the yoke center pole in a same manner as the magnet to form a magnetic gap, and the circular outer magnet type magnetic circuit can be formed and held in the frame via the recess and the through hole.

As set forth in claims 6 to 10, in order to protect the diaphragm, preferably, a protector which is made of a sheet metal, and in which plural sound holes are opened is attached to the face of the frame to which the diaphragm is attached, to cover the diaphragm, and a compensation cloth is applied onto the protector. The compensation cloth exerts a damping function which prevents excess vibration of the diaphragm and air leakage from occurring, to improve acoustic characteristics, and also a dust proofing function.

As set forth in claims 11 to 15, preferably, conductive terminals for supplying an audio signal to the voice coil are integrally attached to respective longitudinal end portions of the frame by insert molding.

As set forth in claim 16, the terminals which are integrally attached to the longitudinal end portions of the frame protrude in an elastically displaceable manner from the longitudinal end portions in one surface of the frame opposite to the face to which the diaphragm is attached, and external connecting portions are formed in end portions of the terminals, respectively.

As set forth in claim 17, preferably, a pair of plate-LIKE Leg portions which are opposed to each other in the longitudinal direction of the frame are protrudingly formed on inner sides of the terminals in the one surface of the frame opposite to the face to which the diaphragm is attached. When the heights of such leg portions are set to be larger than the bending radii of the terminals, the leg portions exert a stopper function of preventing the terminals from being bent beyond the reversible limit. Because of the stopper function, the spring pressures of the terminals can be always maintained, and an audio signal can be stably supplied to the voice coil. The leg portions themselves have a plate-like shape, so that higher strength can be ensured and the leg portions exert also a rib function of enhancing the strength of the frame.

As set forth in claim 18, preferably, a rectangular recess is formed between the leg portions in one surface of the frame opposite to a face to which the diaphragm is attached, a circular through hole penetrating to the face of the frame to which the diaphragm is attached is opened in a bottom face of the recess, and the recess allows the frame to hold the circular outer magnet type magnetic circuit. The leg portions serve as barrier walls which separate the terminals in the longitudinal end portions in the one surface of the frame opposite to the face to which the diaphragm is attached, from the recess (magnetic circuit) between the leg portions, and prevent the terminals from being bent or damaged during a process of incorporating the circuit into the frame.

As set forth in claim 19, preferably, the diaphragm has an oval frame plate in an edge portion, and is joined by the frame plate to an edge portion of the face of the frame to which the diaphragm is attached, and a tip end portion of the voice coil in which one end is fixed to a middle area of the diaphragm is fitted into the magnetic gap.

As set forth in claim 20, the terminals which are integrally attached to the longitudinal end portions of the frame are configured so that internal connecting portions are formed by exposing the terminals embedded in the frame from two of four corners of the face of the frame to which the diaphragm is attached, the two corners being positioned in respective ends of one longitudinal side.

As set forth in claim 21, preferably, lead wires of the voice coil elongate from two circumferential positions of the coil body opposed to longitudinal inner edges of the frame plate of the diaphragm, and are drawn from an inner side of the diaphragm to an outer side toward the internal connecting portions of the frame, via routes each of which elongates along at least part of a semicircular short-side inner edge of the frame plate of the diaphragm. When the lead wires of the voice coil are drawn out in this way, the lead wires can be provided with pulling margin with respect to vertical motions of the voice coil during a process of driving the speaker, thereby enabling smooth driving (vertical vibration) of the voice coil. Moreover, each of the lead wires can be drawn out from the voice coil to the corresponding internal connecting portion while forming only one bend, and abnormalities such as an increased internal resistance due to bending of the lead wires, and excessive heating of the speaker in a long-term continuous operation can be prevented from occurring. Therefore, the acoustic characteristics of the speaker can be improved. Furthermore, it is possible to prevent the lead wires of the voice coil from being tangled with each other during a process of assembling the speaker, whereby the assembling property can be improved.

As set forth in claim 22, preferably, the lead wires of the voice coil elongate from the two circumferential positions of a coil body opposed to longitudinal inner edges of the frame plate of the diaphragm, in a winding direction of a winding of the voice coil.

As set forth in claim 23, preferably, the lead wires of the voice coil are connected by soldering to the terminals exposed in the internal connecting portions, respectively.

As set forth in claim 24, preferably, drawing-out ports for drawing out the lead wires of the voice coil from the inner side of the diaphragm to the outer side are formed in the face of the frame to which the diaphragm is attached.

DETAILED DESCRIPTION OF THE PREFERRED EMBODIMENT

Figure 1:
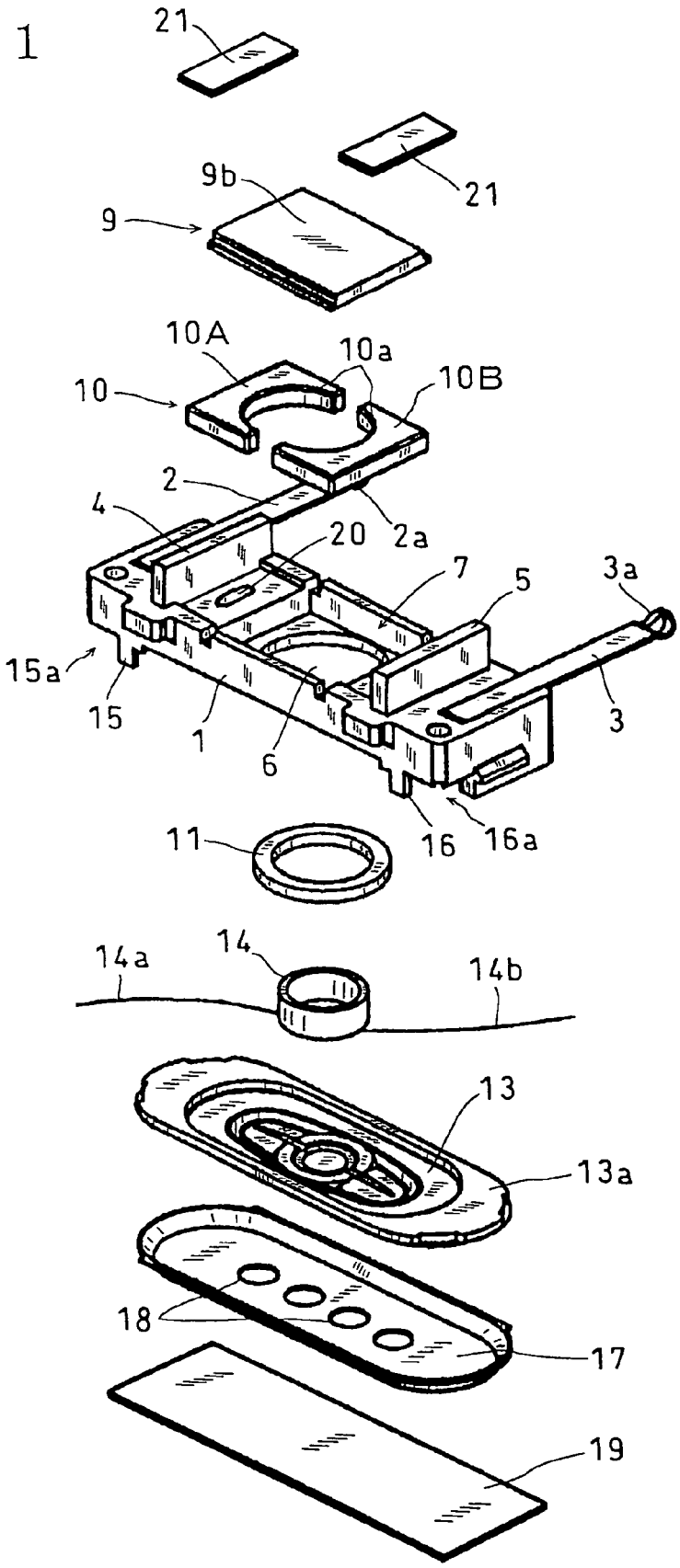
FIG. 1 is an exploded perspective view of a speaker which is an embodiment of the invention.
Figure 2:
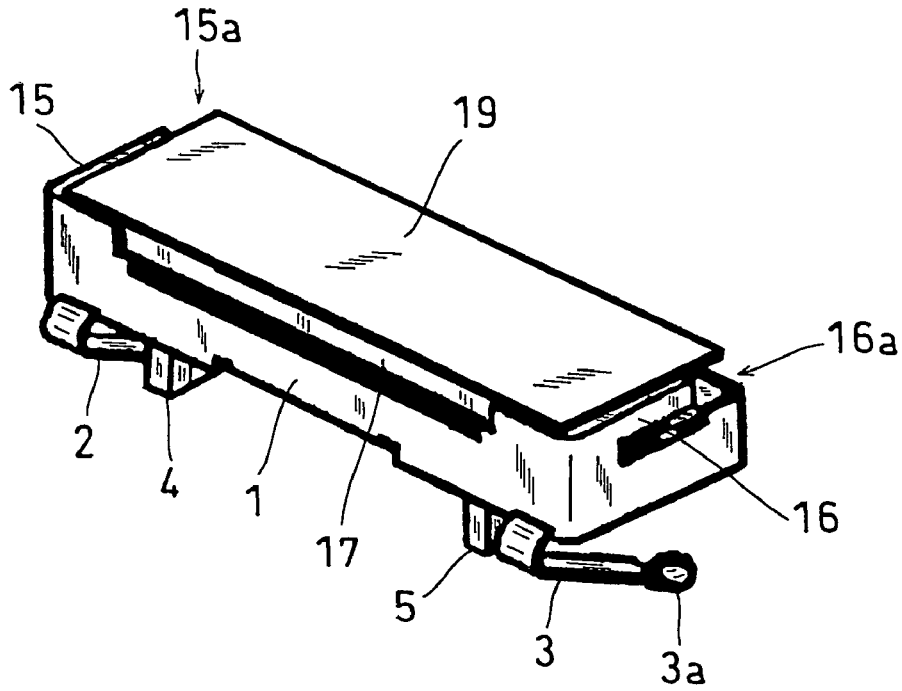
FIG. 2 is an external perspective view of an assembled state of the speaker.
Figure 3:
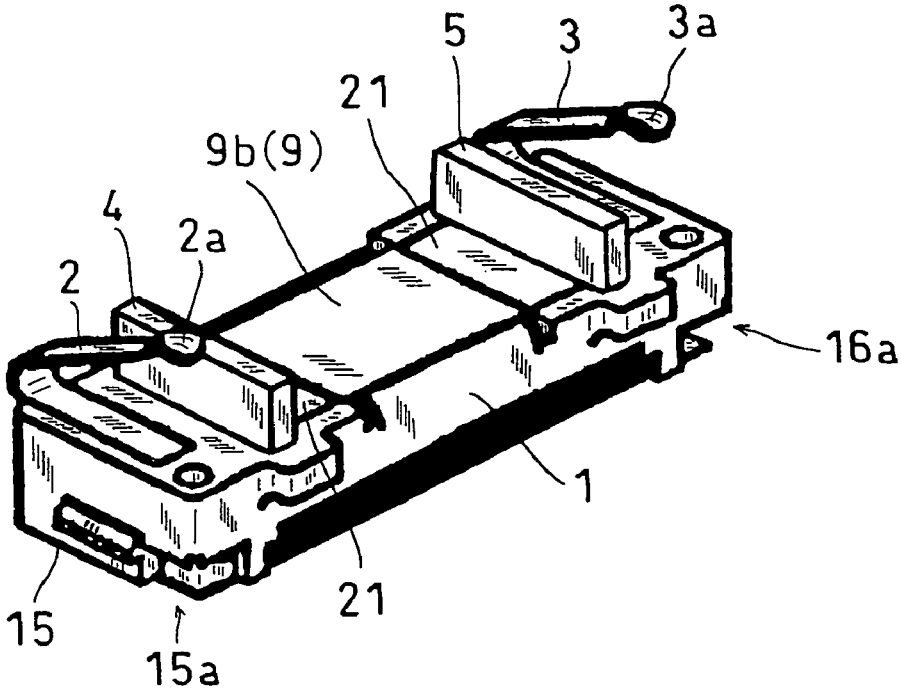
FIG. 3 is an external perspective view of a state where the speaker of FIG. 2 is reversed.

Hereinafter, an embodiment of the invention will be described with reference to the accompanying drawings. In FIG. 1, 1 denotes a (insulative) frame which is made of a resin, and which is formed into a rectangular shape that is laterally elongated (has a narrow fore-aft width). Thin elongated plate-like terminals 2, 3 which are electrically conductive are integrally attached to respective lateral end portions of the frame 1 by insert molding. The terminals 2, 3 in a developed state are inserted in molds during a process of molding the frame 1 so that substantially half portions are embedded in the lateral end portions of the frame 1, and the remaining substantially half portions protrude forward or rearward from the lateral end portions of the lower face of the frame 1 along the short sides of the frame 1. After the process of molding the frame 1, or in a step of assembling a speaker, the terminals are roundedly bent into a substantially V-like shape so that the portions protruding from the frame 1 are within the width of the short side direction on the side of the lower face of the frame 1, and, in the end portions of the lower face side of the frame 1, inclinedly protrude so as to be vertically elastically displaceable. Ends of the terminals 2, 3 on one side protruding from the frame 1 are set as external connecting portions 2*a*, 3*a*, and the other ends of the terminals 2, 3 which are embedded in the frame 1 are exposed from two of the four corners of the upper face of the frame 1 to be set as internal connecting portions 2*b*, 3*b*. The two corners are positioned in the respective ends of one longitudinal side of the frame.

A pair of left and right plate-like leg portions 4, 5 which are opposed to each other in the longitudinal direction of the frame 1 are protrudingly formed immediately inside the terminals 2, 3 on the lower face of the frame 1, and over an approximately whole width of the short-side direction of the frame 1. The heights (protrusion dimensions) of the leg portions 4, 5 are set so as to be higher (larger) than the bending radii of the terminals 2, 3 by a predetermined dimension, so that the leg portions exert a stopper function of preventing the terminals 2, 3 from being bent beyond the reversible limit. Because of the stopper function, the spring pressures of the terminals 2, 3 can be always maintained, and an audio signal current can be stably supplied to the speaker (more specifically, a voice coil which will be described later). The leg portions 4, 5 themselves have a plate-like shape, so that higher strength can be ensured and the leg portions exert also a rib function of enhancing the strength of the frame 1. The leg portions 4, 5 serve as barrier walls which separate the terminals 2, 3 in the end portions of the frame 1 on the lower face of the frame 1 from a magnetic circuit that will be described later, and function also as protective walls which prevent the terminals 2, 3 from being bent or damaged during a process of incorporating the circuit into the frame 1.

Between the leg portions 4, 5 on the lower face of the frame 1, formed is a rectangular recess 7 which is laterally elongated, and in which a circular through hole 6 penetrating to the upper face of the frame 1 is opened in the bottom face. The frame 1 holds the circular outer magnet type magnetic circuit 8 by means of the recess 7. Specifically, the magnetic circuit 8 comprises: a yoke 9 which is made of a magnetic material, and in which a rectangular flange 9*b* is disposed in one end (lower end) of a cylindrical (circular) center pole 9*a*; a plate-like magnet 10 which has a circular center hole 10*a*, which is placed with forming a circular annular gap around the center pole 9*a* of the yoke 9, and which has a rectangular shape that is substantially identical with the shape of the flange 9*b* of the yoke 9; and a circular annular pole piece 11 which is made of a magnetic material, which is substantially equal in inner diameter to the center hole 10*a* of the magnet 10, in which the outer diameter is substantially equal to the short side dimensions of the flange 9*b* of the yoke 9 and the magnet 10, and which cooperates with the flange 9*b* of the yoke 9 to clampingly hold the magnet 10. The yoke 9, the magnet 10, and the pole piece 11 constitute the circular outer magnet type magnetic circuit 8. The magnet 10 is fitted into the recess 7 from the side of the lower face of the frame 1, and the flange 9*b* of the yoke 9 is then pressingly fitted into the recess 7 so as to overlap the outer side of the magnet 10 while inserting the center pole 9*a* of the yoke 9 into the center hole 10*a* of the magnet 10, whereby the center pole 9*a* of the yoke 9 is caused to hang at the center of the recess 7, a tip end portion of the center pole 9*a* is insertedly placed at the center of the through hole 6, lateral end portions of the magnet 10 are clampingly held in the recess 7 and between the bottom face of the recess and the flange 9*b* of the yoke 9, the magnet is placed in a state where a circular annular gap is formed around the center pole 9*a* of the yoke 9, and the lower face of the magnet 10 is joined to the flange 9*b* of the yoke 9. In this state, the pole piece 11 is pressingly fitted to the inner periphery of the through hole 6 from the side of the upper face of the frame 1, whereby the pole piece 11 is placed in a state where a circular annular gap is formed around the tip end portion of the center pole 9*a* of the yoke 9 in the same manner as the magnet 10, an inner peripheral edge portion (a peripheral portion of the center hole 10*a*) of the magnet 10 is clampingly held between the flange 9*b* of the yoke 9 and the pole piece 11, and the pole piece 11 is joined to the upper face of the magnet 10.

As described above, the circular outer magnet type magnetic circuit 8 is formed and held in the frame 1 (in a longitudinal middle portion) via the recess 7 and the through hole 6, and a circular magnetic gap 12 where a magnetic field is produced is formed between the outer peripheral face of the tip end portion of the center pole 9*a* of the yoke 9 in the magnetic circuit and the inner peripheral face of the pole piece 11. The circular magnetic gap 12 is formed in the longitudinal middle portion in the upper face of the frame 1, i.e., the opening of the through hole 6 in the upper face of the frame 1.

Figure 4:
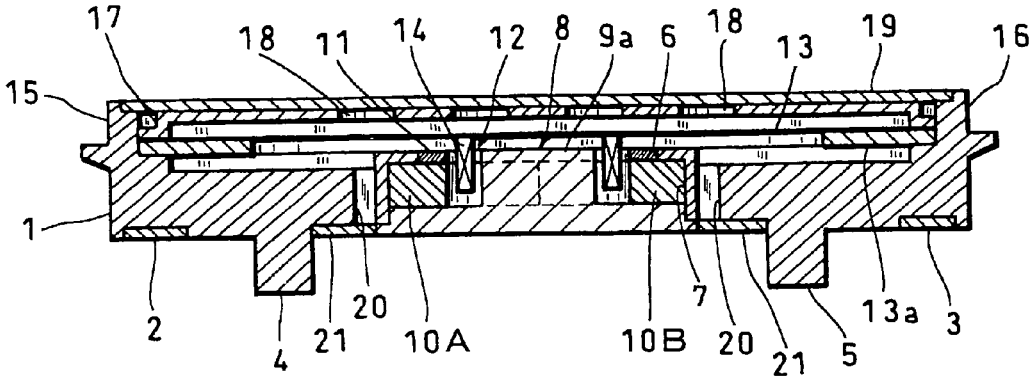
FIG. 4 is a section view of the assembled state of the speaker.

A diaphragm 13 made of a resin film is attached and held to the upper face of the frame 1 (the surface of the frame 1 opposite to the face to which the audio signal current is to be supplied) where the internal connecting portions 2*b*, 3*b* are formed in the two corners which are positioned in the respective ends of the one longitudinal side, and the circular magnetic gap. 12 is opened and formed in the longitudinal middle portion. The diaphragm 13 is formed into an oval shape, and an edge portion of the lower face is joined by an adhesive to the upper face of an oval frame plate 13*a* which is made of a metal material. One end portion of the circular voice coil 14 is fixed by an adhesive to a middle area of the lower face of the diaphragm 13. In FIG. 4, for the sake of convenience, the diaphragm 13 is shown to be flat. In practice, however, a concave and convex pattern is formed with being centered at the joined portion of the voice coil 14 (the middle portion of the diaphragm 13) as shown in FIG. 1, so that the portion covering the oval inner hole of the frame plate 13*a* can vertically vibrate.

The lower face of the frame plate 13*a* of the diaphragm 13 is joined to an outer peripheral edge portion of the upper face of the frame 1, and the diaphragm 13 is stretched and supported above the upper face of the frame 1 with forming a gap therebetween, whereby the tip end portion of the circular voice coil 14 in which one end is fixed to the middle area of the diaphragm 13 is fitted into the circular magnetic gap 12.

Left and right sidewalls 15, 16 which extend along the semicircular short side outer edges of the frame plate 13*a* of the diaphragm 13 are protrudingly formed on left and right end portions of the face (upper face) of the frame 1 to which the diaphragm is attached. The diaphragm 13 is positioned between the sidewalls 15, 16. A protector 17 made of a sheet metal is attached to the upper face of the frame 1 from the upper side of the diaphragm 13 so as to cover the diaphragm 13, and the diaphragm 13 is protected by the protector 17. The protector 17 is formed into an oval shape which is substantially identical with the outer shape of the diaphragm 13, and positioned between the sidewalls 15, 16 so as to be integrated with the diaphragm 13. Plural sound holes 18 are opened in the protector 17 which covers the diaphragm 13 with forming a gap therebetween. A compensation cloth 19 which has a rectangular shape that is substantially identical with the shape of the frame 1 is applied to the upper face of the frame 1 so as to cover the whole upper face from the upper side of the protector 17, by an adhesive or a double sided adhesive tape. The compensation cloth 19 covers the sound holes 18 to exert a damping function which prevents excess vibration of the diaphragm 13 and excess air leakage from occurring, to improve acoustic characteristics, and also a dust proofing function.

In the frame 1 which is on the side of the lower face of the diaphragm 13, two vertical holes or back holes 20 which penetrate from the upper face to the lower face are formed. The back holes 20, 20 are disposed on the lateral sides of the recess 7 which houses the circular outer magnet type magnetic circuit 8. Alternatively, the back holes 20, 20 may be opened in two places between the left and right leg portions 4, 5, and the recess 7 in the lower face of the frame 1, and compensation cloths 21, 21 may be applied to the two places to cover the back holes 20, 20. In the alternative, the compensation cloths 21, 21 exert mainly a dust proofing function, and also a damping function for improving acoustic characteristics.

Figure 5:
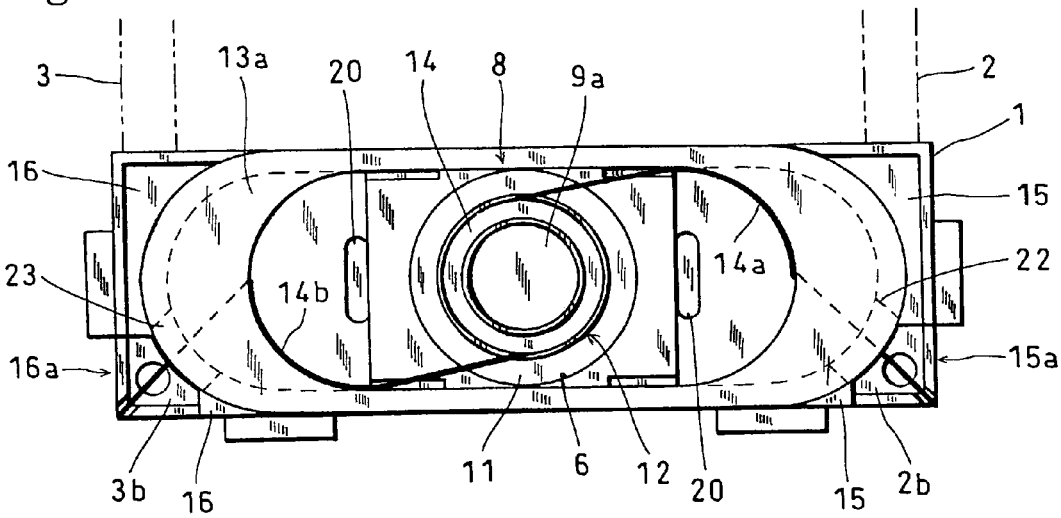
FIG. 5 is a plan view showing a structure for drawing out lead wires of a voice coil.
Figure 6:
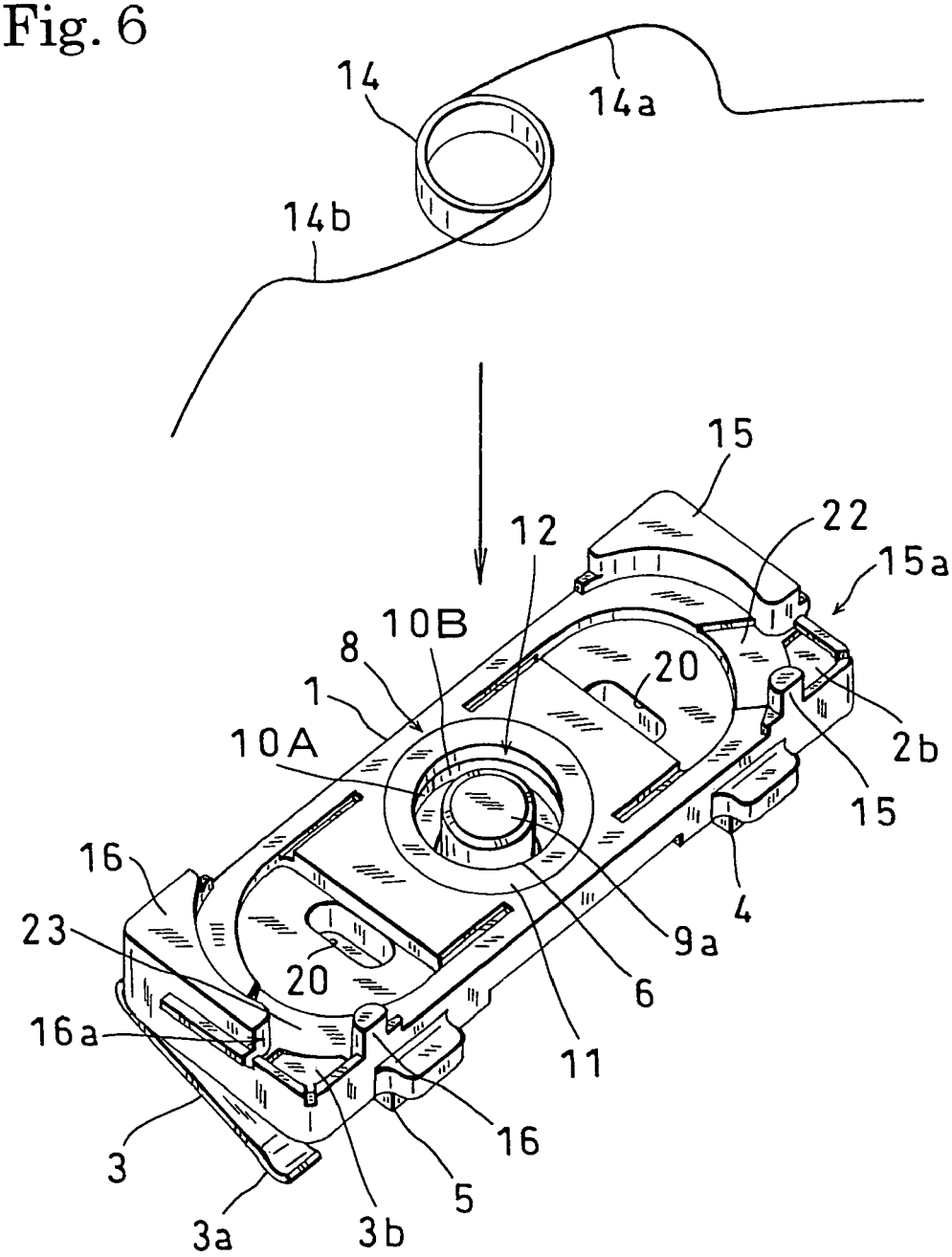
FIG. 6 is a perspective view showing a state where the voice coil is attached to a frame.
Figure 7:
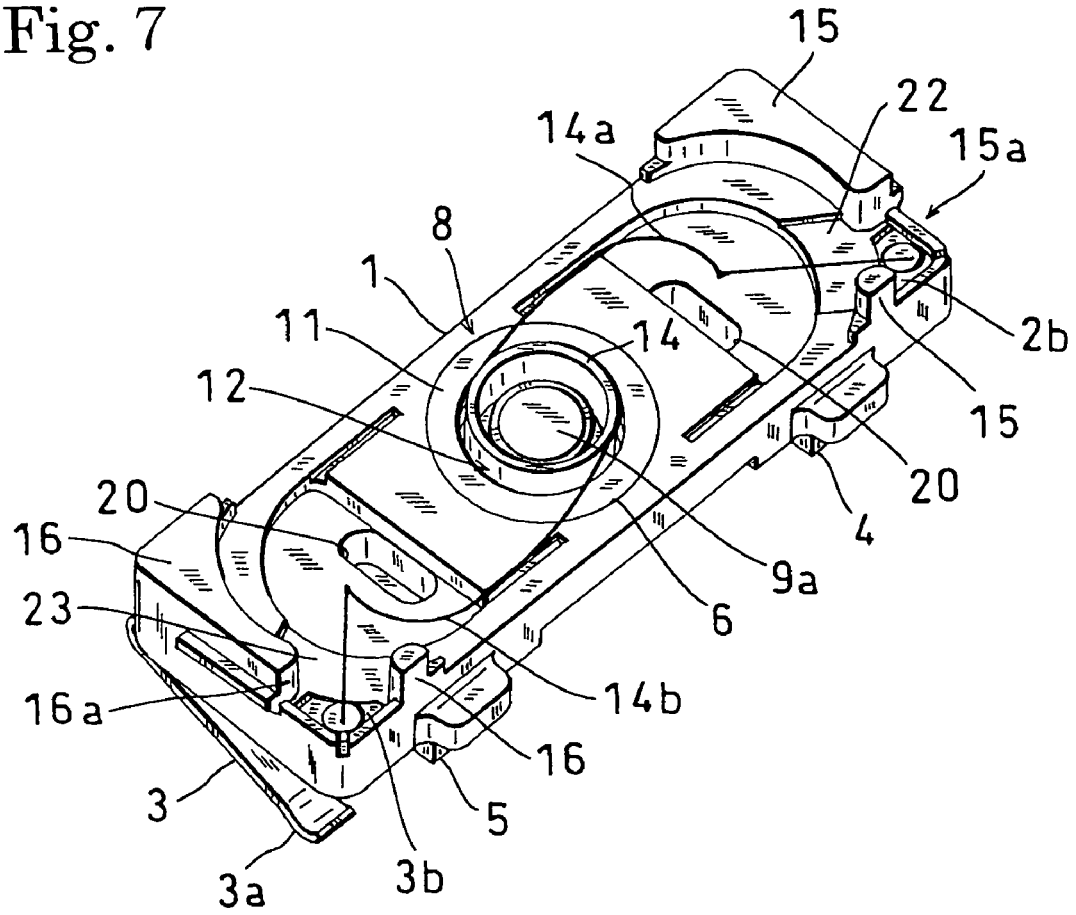
FIG. 7 is a perspective view showing the structure for drawing out the lead wires of the voice coil.

Lead wires 14*a*, 14*b* of the voice coil 14 elongate from two circumferential positions (about 180-deg. symmetry positions) of an upper end portions of a coil body opposed to linear longitudinal inner edges of the frame plate 13*a* of the diaphragm 13, along the inner edge of the frame plate 13*a* of the diaphragm 13 in the winding direction of the winding (for example, a copper wire covered by an insulating layer of urethane resin or the like) of the voice coil 14, and are drawn out from the inner side of the diaphragm 13 to the outer side toward the respective internal connecting portions 2*b*, 3*b* of the frame 1, via routes each of which elongates along at least part of a semicircular short-side inner edge of the frame plate 13*a* of the diaphragm 13. For example, the case where the winding of the voice coil 14 is wound in a right-handed manner (a clockwise direction) in FIG. 5 will be considered. The one lead wire 14*a* which elongates from a position opposed to one linear longitudinal inner edge (the linear inner edge in the upper side of the sheet) of the frame plate 13*a* of the diaphragm 13 elongates from a middle portion of the linear longitudinal inner edge (the linear inner edge in the upper side of the sheet) of the frame plate 13*a* of the diaphragm 13 opposed to the elongating position, in a right-handed manner (a clockwise direction) along the right semicircular short-side inner edge continuous to the right end of the middle portion, and drawn out from the inner side of the diaphragm 13 to the outer side so as to be directed from a substantially middle portion of the right semicircular short-side inner edge toward the internal connecting portion 2*b* which is in one side of the frame 1. The lead wire 14*a* which is exposed from the insulating covering layer is electrically connected by soldering to an end of the one terminal 2 exposed in the internal connecting portion 2*b* in the one side of the frame 1. By contrast, the other lead wire 14*b* which elongates from a position opposed to the other linear longitudinal inner edge (the linear inner edge in the lower side of the sheet) of the frame plate 13*a* of the diaphragm 13 elongates from a middle portion of the linear longitudinal inner edge (the linear inner edge in the lower side of the sheet) of the frame plate 13*a* of the diaphragm 13 opposed to the elongating position, in a right-handed manner (a clockwise direction) along the left semicircular short-side inner edge continuous to the left end of the middle portion, and drawn out from the inner side of the diaphragm 13 to the outer side so as to be directed from a substantially middle portion of the left semicircular short-side inner edge toward the internal connecting portion 3*b* which is in the other side of the frame 1. The lead wire 14*b* which is exposed from the insulating covering layer is electrically connected by soldering to an end of the other terminal 3 exposed in the internal connecting portion 3*b* in the other side of the frame 1. After the lead wires 14*a*, 14*b* of the voice coil 14 are soldered to the end portions of the terminals 2, 3 exposed in the internal connecting portions 2*b*, 3*b*, excess portions of the lead wires which are exposed from the frame 1 are cut away.

The sidewalls 15, 16 which protrude from the end portions of the upper face of the frame 1 are interrupted in two corners positioned in both ends of one longitudinal side of the upper face of the frame 1 where the internal connecting portions 2*b*, 3*b* are formed, thereby forming interrupted portions 15*a*, 16*a* which cause the sidewalls not to be continuous. Drawing-out grooves 22, 23 are formed in positions where the lead wires 14*a*, 14*b* are drawn out in the oval joining face to which the lower face of the frame plate 13*a* of the diaphragm 13 is joined, i.e., in routes of drawing out the lead wires 14*a*, 14*b* on the joining face connecting the substantially middle portions of the left and right semicircular short-side inner edges of the frame plate 13*a* of the diaphragm 13 and the left and right internal connecting portions 2*b*, 3*b* of the frame 1. The drawing-out grooves 22, 23 on the joining face, and the interrupted portions 15*a*, 16*a* of the sidewalls 15, 16 form drawing-out ports for drawing out the lead wires 14*a*, 14*b* of the voice coil 14 from the inner side of the diaphragm 13 to the internal connecting portions 2*b*, 3*b* in the outer side.

As described above, the lead wires 14*a*, 14*b* of the voice coil 14 elongate from the two circumferential positions (about 180-deg. symmetry positions) of the upper end portions of the coil body opposed to the linear longitudinal inner edges of the frame plate 13*a* of the diaphragm 13, along the inner edge of the frame plate 13*a* of the diaphragm 13 in the winding direction of the winding of the voice coil 14, and are drawn out from the inner side of the diaphragm 13 to the outer side toward the internal connecting portions 2*b*, 3*b* of the frame 1, via the routes each of which elongates along at least part of the semicircular short-side inner edge of the frame plate 13*a* of the diaphragm 13. According to this configuration, the lead wires 14*a*, 14*b* can be provided with pulling margin with respect to vertical motions of the voice coil 14 during a process of driving the speaker, thereby enabling smooth driving (vertical vibration) of the voice coil 14, and each of the lead wires 14*a*, 14*b* can be drawn out from the voice coil 14 to the corresponding internal connecting portion 2*b* or 3*b* of the frame 1 while forming only one bend, so that abnormalities such as an increased internal resistance due to bending of the lead wires 14*a*, 14*b*, and excessive heating of the speaker in a long-term continuous operation can be prevented from occurring. Therefore, the acoustic characteristics of the speaker can be improved. Furthermore, it is possible to prevent the lead wires 14*a*, 14*b* of the voice coil from being tangled with each other during a process of assembling the speaker, whereby also the assembling property can be improved.

In the speaker of the embodiment, when an audio signal current is supplied from an audio system to the voice coil 14 via the terminals 2, 3, the diaphragm 13 to which the voice coil 14 is fixed is vibrated by an electromagnetic action with a magnetic field in the magnetic gap 12, to generate a sound or a voice. Since the magnetic circuit 8 which forms the magnetic gap 12 is of the outer magnet type in which the magnet 10 is placed on the outer periphery of the magnetic gap 12, the height can be made smaller than that in the case of an inner magnet type one in which a magnet is placed inside the magnetic gap, and a large coil driving force (sound pressure) can be ensured by a small magnet. Therefore, the embodiment is effective in further miniaturization and thinning of a speaker.

In the embodiment, all the outer magnet type magnetic circuit 8, the magnetic gap 12, and the voice coil 14 have a circular shape. A magnet which is usually used in the circular outer magnet type magnetic circuit 8 has a circular annular shape. Therefore, the magnet can be ensured to have higher strength as compared with a rectangular annular (frame-like) magnet which is usually used in a rectangular outer magnet type magnetic circuit. In the embodiment, since the magnet used in the outer magnet type magnetic circuit 8 is the plate-like magnet 10 which has the circular center hole 10*a*, which is placed with forming the circular annular gap around the center pole 9*a* of the yoke 9, and which has a rectangular shape that is substantially identical with the shape of the yoke flange 9*b* of the yoke 9, moreover, it is possible to ensure more higher strength than a circular annular magnet which is usually used in the circular outer magnet type magnetic circuit 8. Therefore, losses due to cracks, edge defects, and the like in production of the magnet 10 are reduced, and the productivity can be enhanced. Consequently, an outer magnet type magnetic circuit can be employed without problems as a magnetic circuit 8 for the speaker held on the rectangular frame 1, and further miniaturization and thinning of a speaker can be realized.

Figure 8:
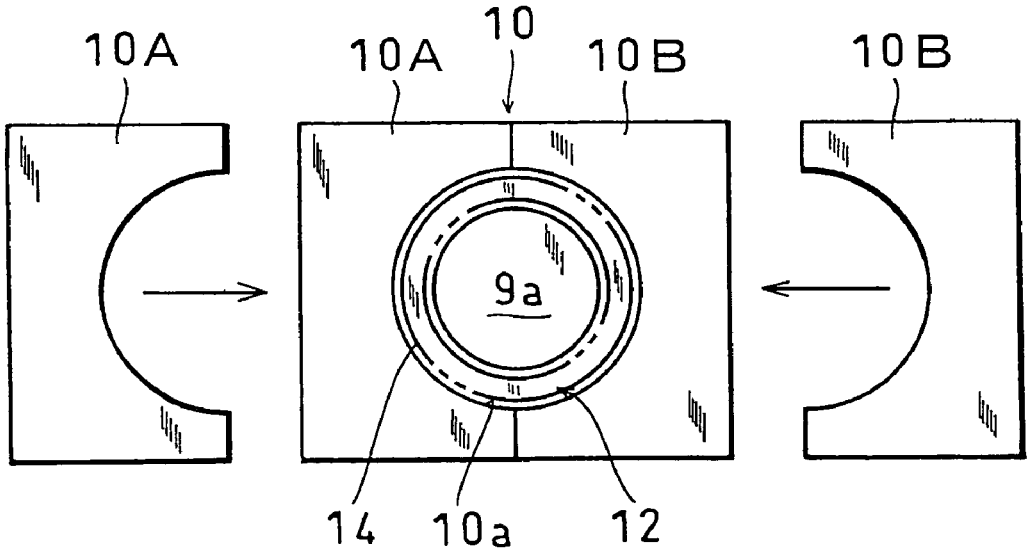
FIG. 8 is a plan view of a magnet having a split structure.
Figure 9:
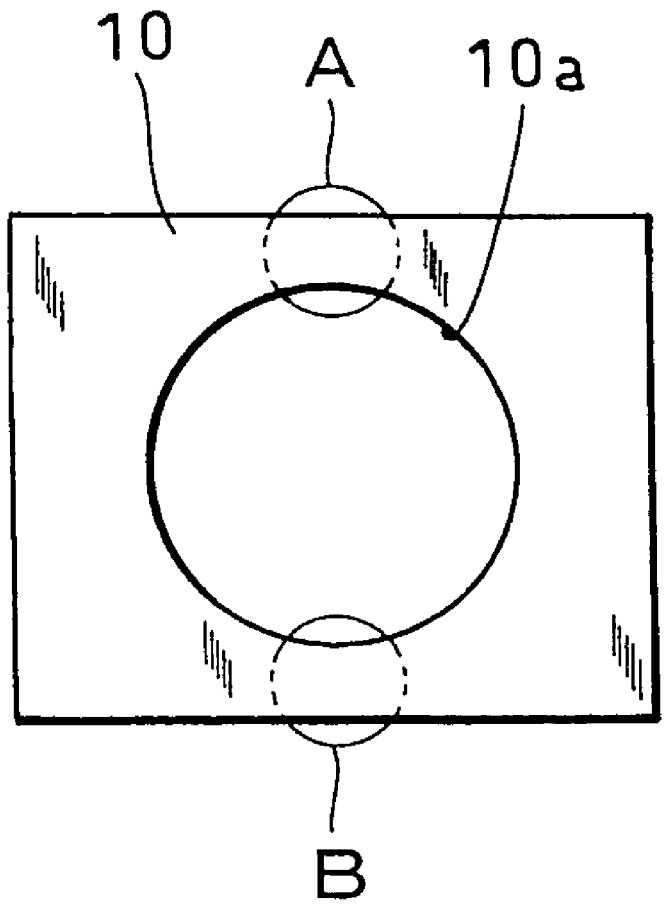
FIG. 9 is a plan view of a magnet having an integral structure.

Even in the plate-like magnet 10 which has the circular center hole 10*a*, which is placed with forming a circular annular gap around the center pole 9*a* of the yoke 9, and which has a rectangular shape that is substantially identical with the flange 9*b* of the yoke 9, when the short side dimension of the magnet is shorter than the outer diameter of a circular annular magnet which is usually used in a circular outer magnet type magnetic circuit, as shown in FIG. 9, the strength is insufficient in two places A, B where the center hole 10*a* of the magnet 10 is closest to the longitudinal outer side edges, thereby causing a possibility that cracks occur in the two places A, B. Therefore, miniaturization of a speaker in the short side direction is particularly difficult. In the embodiment, the magnet is configured so as not to have an integral structure (the magnet 10 shown in FIG. 9), but as the magnet 10 having a split structure in which the magnet is originally split into two portions in a center area in the longitudinal direction, as shown in FIG. 8, or formed by the two split magnets 10A, 10B. According to this configuration, even when the short side dimension of the magnet 10 is shorter than the outer diameter of a circular annular magnet which is usually used in a circular outer magnet type magnetic circuit, it is possible to ensure strength which is not problematic in production of the magnet 10. Therefore, further miniaturization of a speaker in the short side direction can be realized.

When a speaker is requested to be further miniaturized, the split number of the magnet 10 may be adequately increased, so that insufficiency of strength can be solved and the request can be satisfied.

What is claimed is:

1. A speaker wherein a circular outer magnet type magnetic circuit, a circular voice coil which is driven by said magnetic circuit, and a diaphragm to which said voice coil is fixed are held on a rectangular frame said circular outer magnet type magnetic circuit is configured by:

a yoke in which a rectangular flange is disposed in one end of a circular center pole;

a plate-like magnet which has a circular center hole, which is placed with forming a circular annular gap around said yoke center pole, and which has a rectangular outer shape that is substantially identical with an outer shape of said yoke flange;

a circular annular pole piece which is substantially equal in inner diameter to said magnet center hole, in which an outer diameter is substantially equal to short side dimensions of said yoke flange and said magnet, and which cooperates with said yoke flange to clampingly hold said magnet; and a circular magnetic gap into which said circular voice coil is fitted is formed between an outer peripheral face of said yoke center pole of said magnetic circuit and an inner peripheral face of said pole piece, wherein:

conductive terminals for supplying an audio signal to said voice coil are integrally attached to respective longitudinal end portions of said frame by insert molding;

said terminals protrude in an elastically displaceable manner from said frame in said longitudinal end portions in one surface of said frame opposite to said face to which said diaphragm is attached, and external connecting portions are formed in end portions of said terminals, respectively; and said diaphragm has an oval frame plate in an edge portion, and is joined by said frame plate to an edge portion of said face of said frame to which said diaphragm is attached, and a tip end portion of said voice coil in which one end is fixed to a middle area of said diaphragm is fitted into said magnetic gap.

2. The speaker according to claim 1, wherein said magnet is split into two portions in a center area in a longitudinal direction.

3. The speaker according to claim 2, wherein a protector which is made of a sheet metal, and in which plural sound holes are opened is attached to said face of said frame to which said diaphragm is attached, to cover said diaphragm, and a compensation cloth is applied onto said protector.

4. The speaker according to claim 1, wherein a rectangular recess is formed in one surface of said frame opposite to the face to which said diaphragm is attached, a circular through hole penetrating to said face of said frame to which said diaphragm is attached is opened in a bottom face of said recess, and said recess allows said frame to hold said circular outer magnet type magnetic circuit.

5. The speaker according to claim 4, wherein said magnet is fitted into said recess of said frame, said yoke flange is fitted into said recess so as to overlap an outer side of said magnet while inserting said yoke center pole into said magnet center hole, whereby said yoke center pole is caused to hang at a center of said recess, a tip end portion of said yoke center pole is insertedly placed at a center of said through hole, and said magnet is placed in a state where the circular annular gap is formed around said yoke center pole, and, in this state, said pole piece is fitted to an inner periphery of said through hole from a side of said face of said frame to which said diaphragm is attached, whereby said pole piece is placed in a state where the circular annular gap is formed around the tip end portion of said yoke center pole in a same manner as said magnet to form the magnetic gap, and said circular outer magnet type magnetic circuit is formed and held in said frame via said recess and said through hole.

6. The speaker according to claim 5, wherein a protector which is made of a sheet metal, and in which plural sound holes are opened is attached to said face of said frame to which said diaphragm is attached, to cover said diaphragm, and a compensation cloth is applied onto said protector.

7. The speaker according to claim 4, wherein a protector which is made of a sheet metal, and in which plural sound holes are opened is attached to said face of said frame to which said diaphragm is attached, to cover said diaphragm, and a compensation cloth is applied onto said protector.

8. The speaker according to claim 1, wherein a protector which is made of a sheet metal, and in which plural sound holes are opened is attached to said face of said frame to which said diaphragm is attached, to cover said diaphragm, and a compensation cloth is applied onto said protector.

9. The speaker according to claim 1, wherein a pair of plate-like leg portions which are opposed to each other in the longitudinal direction of said frame are protrudingly formed on inner sides of said terminals in said one surface of said frame opposite to said face to which said diaphragm is attached.

10. The speaker according to claim 9, wherein a rectangular recess is formed between said leg portions in said one surface of said frame opposite to said face to which said diaphragm is attached, a circular through hole penetrating to said face of said frame to which said diaphragm is attached is opened in a bottom face of said recess, and said recess allows said frame to hold said circular outer magnet type magnetic circuit.

11. The speaker according to claim 1, wherein:

internal connecting portions are formed by exposing said terminals embedded in said frame from two of four corners of said face of said frame to which said diaphragm is attached, said two corners being positioned in respective ends of one longitudinal side;

lead wires of said voice coil elongate from two circumferential positions of a coil body opposed to longitudinal inner edges of said frame plate of said diaphragm, and are drawn from an inner side of said diaphragm to an outer side toward said internal connecting portions of said frame, via routes each of which elongates along at least part of a semicircular short-side inner edge of said frame plate of said diaphragm; and said lead wires of said voice coil elongate from said two circumferential positions of said coil body opposed to longitudinal inner edges of said frame plate of said diaphragm, in a winding direction of a winding of said voice coil.

12. The speaker according to claim 11, wherein said lead wires of said voice coil are connected by soldering to said terminals exposed in said internal connecting portions, respectively.

13. The speaker according to claim 11, wherein drawing-out ports for drawing out said lead wires of said voice coil from the inner side of said diaphragm to the outer side are formed in said face of said frame to which said diaphragm is attached.

* * * * *